United States Patent [19]

Noel

[11] Patent Number: 4,980,681

[45] Date of Patent: Dec. 25, 1990

[54] DIRECT VIEW REMOTE CONTROL METHOD FOR WORKINGS MACHINE AND TRANSMITTER AND RECEIVER ASSEMBLY FOR CARRYING OUT SUCH METHOD

[75] Inventor: Marc S. Noel, Oise, France

[73] Assignee: Charbonnages De France, Paris, France

[21] Appl. No.: 913,572

[22] Filed: Sep. 29, 1986

Related U.S. Application Data

[63] Continuation of Ser. No. 665,111, Oct. 26, 1984, abandoned.

[30] Foreign Application Priority Data

Nov. 4, 1983 [FR] France ..... 83 17557

[51] Int. Cl.[5] ..... G08C 19/00; E21C 35/24

[52] U.S. Cl. ..... 340/825.690; 180/167; 299/30; 340/825.72

[58] Field of Search ..... 180/167; 340/825.69, 340/825.72, 696; 299/30

[56] References Cited

U.S. PATENT DOCUMENTS

| | | | |
|---|---|---|---|
| 3,337,992 | 8/1967 | Tolson | 340/539 X |
| 3,587,769 | 6/1971 | Lotter | 180/167 |
| 3,856,104 | 12/1974 | Ohba | 180/167 |
| 4,072,898 | 2/1978 | Hellman et al. | 340/825.69 X |
| 4,104,592 | 8/1978 | Ratz et al. | 340/825.72 |
| 4,143,368 | 3/1979 | Route et al. | 340/543 |
| 4,236,594 | 12/1980 | Ramsperger | 180/167 |
| 4,287,596 | 9/1981 | Chari | 360/43 X |
| 4,334,221 | 6/1982 | Rosenhagen et al. | 340/825.69 X |
| 4,413,261 | 11/1983 | Greenberg | 340/825.69 X |
| 4,426,637 | 1/1984 | Apple et al. | 340/825.69 X |
| 4,430,652 | 2/1984 | Rothenbuhler et al. | 340/825.69 |

FOREIGN PATENT DOCUMENTS

| | | |
|---|---|---|
| 2191796 | 1/1974 | France . |
| 1603837 | 12/1981 | United Kingdom . |

OTHER PUBLICATIONS

Industrie Minerale: Les Techniques, Suppl. 3-81, mars 1981, pp. 205-209, Ulrych: "La radio en taille". Page 205, colonne de gauche, ligne 8—page 207, colonne de droite, ligne 20; figure 1.

*Primary Examiner*—Ulysses Weldon
*Attorney, Agent, or Firm*—Browdy and Neimark

[57] ABSTRACT

A direct view remote control method, and a corresponding transmitter and receiver assembly, for rapid and reliable transmission of simultaneous orders to a works machine such as for mines and quarries. Orders from a driver are converted into binary signals; a sequential binary signal is elaborated therefrom so that each sequence comprises synchronization bits with a synchronization binary periodic signal and information bits occupied by a biphased encoded binary signal representative of said binary signals; Amplitude of carrier wave is modulated by said sequential binary signal so as to form a remote control signal to be transmitted; after reception thereof the sequential signal is restored and, through recognition therein of the synchronization signal, converted into appropriate electric signals for the machine.

13 Claims, 6 Drawing Sheets

DIRECT VIEW REMOTE CONTROL METHOD FOR WORKINGS MACHINE AND TRANSMITTER AND RECEIVER ASSEMBLY FOR CARRYING OUT SUCH METHOD

This application is a continuation of application Ser. No. 665,111, filed Oct. 26, 1984 now abandoned.

This invention relates to a direct view remote control of a works appliance or machine adapted to execute pluralities of simultaneous orders. It applies more particularly but not exclusively to the remote control of mine and quarry machines, for example a subterranean works machine such as an undercutting machine or else a carrier conveyor.

It is well known that the remote control of works machines or appliances has the main purpose of maintaining the driver or the pilot of the machine away from a working area considered to be dangerous or placing him under better working conditions.

These objects appear particularly crucial in case of working zones filled with dust, possibly rendered dangerous by falling down of blocks where the driver must be able to control and visually follow up the operations while remaining himself under shelter. This is the case in particular with undercutting machines working on faces with inclined seams or trucks working in extraction chambers. This is then a "direct view" remote control.

In view of the bad working conditions mentioned above it is obviously almost indispensable that the remote control should not make use of a cable capable of being crushed, wedged or cut. Therefore, it is proceeded conventionally by modulating a carrier wave adapted to travel in electromagnetic form from a transmitter to a receiver with frequencies selected as a function of instructions supplied by the pilot (see for example: "La radio en taille" in INDUSTRIE MINERALE: Les Techniques, Suppl. 3-81, mars 1981, p. 205–209, Paris, France): the corresponding informational flow is low.

Such remote controls which are performing satisfactorily present however disadvantages, in particular, since they do not permit to send simultaneous orders, this being restricting when it is necessary to control in parallel for example the output from a jack or the rotation of an arm (discrete or pulse like orders) as well as the sense and the speed of motion of the machine or one element thereof (variable orders).

Generally speaking, direct view remote controls presently known appear currently to be insufficiently reliable in view of spurious signals which may alter electromagnetic waves between transmitter and receiver and any obstacles encountered by said waves, thereby leading to complex circuits for enabling the received instructions on the one hand, and on the other hand, in view of the high power sometimes required for transmission in particular in subterranean working sites, where the major portion of a transmitted wave is absorbed by walls, thereby requiring the transmitter to be associated with a high capacity supply power storage unit by means of a supple cable which is liable to be damaged.

Moreover, direct view remote controls presently known are not adaptable to a double control, with two transmitters shared by a driver and his assistant; however, this is more and more needed nowadays.

Furthermore, such remote control must be devised specifically in each case as a function of the specific machine to be equipped therewith, thereby causing high costs and difficulties of repair in case of failures.

This invention intends to remedy such disadvantages by a remote control method for permitting transmission of simultaneous orders with high dynamics in operation and providing preferably high reliability when taking the instructions into account, in particular in the case of an emergency stop order, true autonomy of the transmitter for long periods of time and possibility of a double control.

For this purpose, the invention proposes a direct view remote control method for works machine, such as for mines and quarries, comprising the steps of:

converting orders from a driver of the machine into binary signals, elaborating from said binary signals a sequential binary signal in which each sequence comprises synchronization bits occupied by a synchronization binary periodic signal and information bits including a biphased encoded binary signal representative of said binary signals, modulating amplitude of a carrier wave with said sequential binary signal so as to define a remote control signal to be transmitted, restoring said modulation sequential binary signal after reception of said remote control signal, and converting said modulation sequential binary signal, through recognition of the synchronization signal therein, into appropriate electric signals for controlling said machine, whereby rapid and reliable transmission of simultaneous orders to said machine is allowed.

In a preferred form of embodiment of the invention, for the remote control of an appliance comprising a variable control member, a plurality of orders constitute an independant group of orders which corresponds to various possible values of an electric signal for controlling said member.

It is to be noted that the fact of taking into account such a variable order implies that its admitted range was rendered discontinuous by arranging a plurality of intermediary terminals for positioning a slider between extreme positions. The distribution of such terminals can be regular (proportional orders) or may have density variations in particular for the low values of the electric control signal.

According to one advantageous characteristic of the invention, transmission of an emergency stop order corresponds to the synchronization signal occupying information bits in the sequential binary signal. It is advantageous for that purpose that frequency of this synchronization signal is an even multiple of transitory frequencies which may appear in information bits of the biphased encoded binary signal. It is to be noted that use of synchronization frequency for elaborating an emergency stop order provides a high safety since emergency stop detection circuits are thus, for the major part thereof, checked in current operation for detection of the synchronization signal in the sequential binary signal as received. Preferably prolonged absence of this synchronization signal results in a "failure" stop order for the machine.

According to another advantageous characteristic of the invention, the validity of the modulation signal recovered at the receiver is tested by exploiting redundance of the binary signals in a predetermined number of successive sequences.

According to another advantageous characteristic, the transmission of variable orders alone is intermittent, for instance, for 200 ms per second in order to spare the load of the supply power storage unit which may possibly be made integral with the transmitter. This invention however contemplates that during the intermittence periods the carrier wave is transmitted continuously, at a low power though, to permit fast restoration of the timing.

With the remote control method according to the invention, it is possible to equip a works machine with several control channels with close enough carrier waves to permit if need be the machine in question to be driven by several persons i.e. the driver himself and at least one assistant. Advantageously, the driver has exclusive control over the variable orders, and the remote control of this invention provides for elimination of any variable orders transmitted with a carrier wave differing from that granted to the driver.

A transmitter and receiver assembly for carrying out the above method is another object of the invention.

It is to be noted that a transmitter and receiver assembly for carrying out the method of this invention is modular and evolutional.

Other objects, characteristics and advantages of this invention will appear from the following description given by way of non limitative example in reference to the attached drawings in which.

Figure 1:
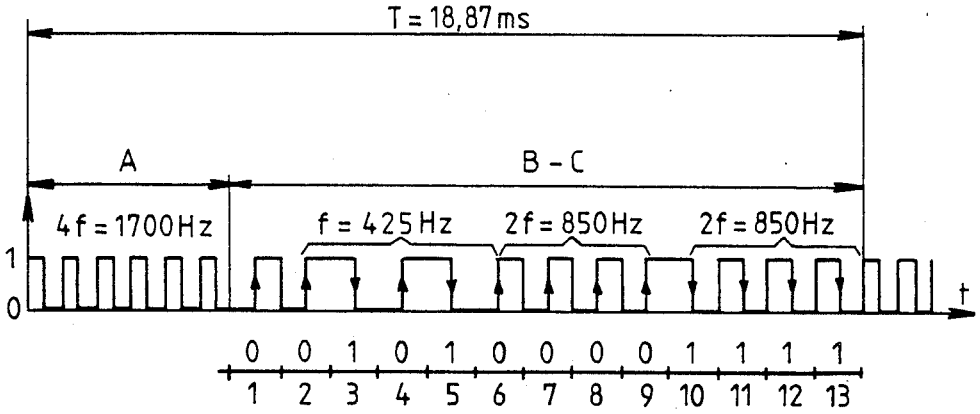
FIG. 1 is a diagram showing a sequence of a modulation signal according to the invention.

FIG. 1 shows a sequence in a sequential binary signal used according to the invention for the modulation of a carrier wave radiated as an electromagnetic wave from a transmitter to a receiver. Such sequence comprises two groups of signals A and B-C. Group A is formed by a periodical timing or synchronization binary signal. Group B-C comprises binary signals of variable frequency which translate the instructions to be transmitted to the remote control machine, such instructions being previously converted into binary code. Part of the bits (group B) correspond to a first group of independent orders, for example, temporary discrete orders, whereas the other part (group C) correspond to a second group of independent orders, for example, variable orders. In this way, a plurality of orders can be transmitted simultaneously.

It is specified that the binary encoding of the variable orders requires definition of intermediary positions between the extreme values of such orders.

Practically, certain bits can be unused when the total number of orders to be transmitted is lower than the number of possibilities provided by the total number of information bits in each sequence.

In the example shown in FIG. 1, the sequence is divided into 16 times, i.e. 3 times are provided for the timing signals (at the rate of 2 gating pulses for 1 time) and 13 times are available for transmission of information. Obviously, the number of orders transmittable in parallel is the lower the higher the number of different orders to be transmitted.

According to an essential characteristic of the invention the encoding of the information bits is of the biphased type, with the value of the binary encoded state in each information bit being translated by the sense of a binary transition in the middle of such bits so that a positive median transition corresponds to a binary state 0, and reversely. The various binary states are specified in FIG. 1, above the order numbers of the bits in the sequence.

It can be noted therefore from FIG. 1 that a succession of alternate binary states (0101. . . ) is translated by biphased encoded signals the frequency of which, equal to the frequency of the bits, is minimum (denoted f), whereas a succession of identical binary states, 0 or 1, is translated by biphased encoded signals having a frequency (denoted 2f) double of the preceding one. The frequency of the timing signals is still an even multiple of the latter, i.e. 4f in the example under consideration.

The square signals at f and 2f only present harmonic components of odd numbers (3, 5. . . ) such that the spectral components of the sequential signals relative to the information bits (groups B and C), on the one hand, and on the other hand, the timing (group A) are well distinct on the frequency scale. This property permits to extract from the sequential signals recovered at the reception those timing signals which are required for decoding each sequence.

The repetition rate of the sequences is (f/8).

The invention proposes by way of example to select a timing frequency of 1700 Hz. The spectral components of information signals are then preferably 425 Hz and 850 Hz, whereas the sequence repetition rate is 53.125 Hz (hence, sequences of 18.87 ms).

As required for any machine remote control a remote control method in accordance with the invention is adapted for transmitting an emergency stop order AU. According to the invention, it is more particularly contemplated that such signal should be a periodical gate pulse signal the frequency of which is that of the timing signal i.e. 1700 Hz in the example of FIG. 1.

Figure 2:
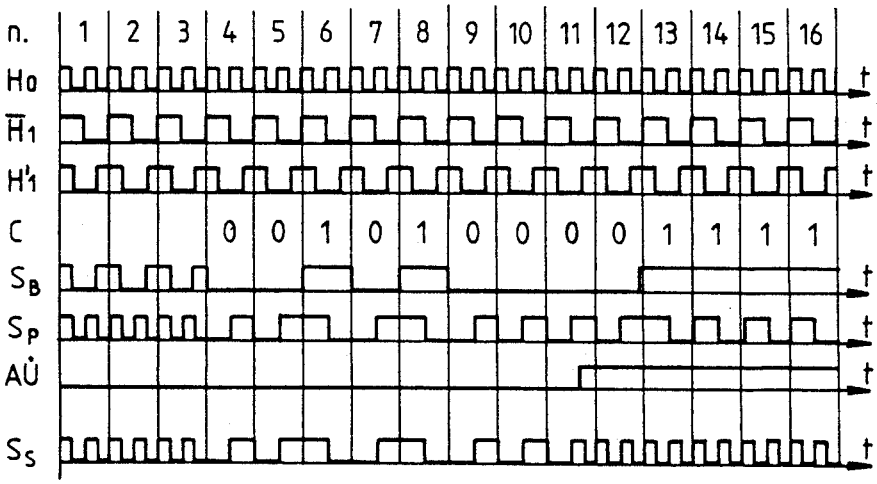
FIG. 2 is a chronogram representing the setting up of a modulation sequence as a function of the binary states of the signals associated with the driver's instructions.

The principle of the operations of binary encoding is shown in detail in the chronogram of FIG. 2.

Various clock signals are obtained by reiterated divisions by 2; they are required for building up the sequential signal:

$H_0$ of frequency 4f (1700 Hz);

$\overline{H}_1$ and $H'_1$ of frequency 2f (850 Hz) with however a phase shift lagging by a quarter of cycle between $H'_1$ and $\overline{H}_1$, and $H_2$ to $H_5$ corresponding to frequencies f, f/2. . . f/8 are used for the definition of the sequences.

The line "n" corresponds to the order numbers of the 16 times of the sequence, whereas line "C" corresponds to the binary states of the command orders for the last 13 times in the sequence.

There is built up a binary signal $S_B$ which takes again the signal $H'_1$ for the 3 first times, then takes a zero level for the binary states 0 of "C" and a maximum level for the values 1 of "C".

A primary sequential signal $S_p$ is then built up the level of which is maximum when $S_B$ and $\overline{H}_1$ are both maximum and minimum, or minimum when $S_B$ and $\overline{H}_1$ are of different levels.

A sequential output signal $S_s$ is finally built up after taking into account a possible emergency stop order which appears during the time 11 in the sequence shown in FIG. 2. The signal $S_s$ takes again the value of the primary sequential signal $S_p$ as long as the signal AU is zero. As soon as the latter becomes maximum signal $H_0$ is substituted for $S_p$ in $S_s$. This signal $S_s$ is used for modulating the carrier wave radiated from the transmitter to the receiver.

Figure 3:
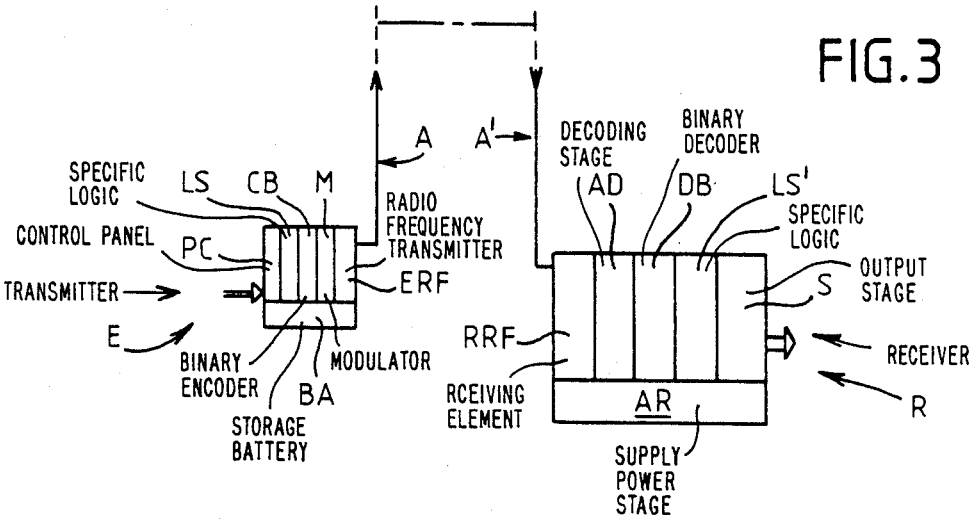
FIG. 3 is a block diagram of a transmitter and receiver assembly for carrying out the remote control method of the invention.

FIG. 3 schematically illustrates the structure of a transmitter and receiver assembly for carrying out a remote control method in accordance with the invention. The transmitter section E is shown on a smaller scale than the receiver section R to show that the transmitter section is generally portable and therefore smaller a priori than the receiver section which is fixedly mounted to the machine.

Only the main components of the transmitter E and the receiver R have been shown schematically in FIG. 3. Thus, the orders from the driver are introduced into the transmitter E through a control panel PC provided with the circuit breakers, switches, sliders and push-buttons as required. The orders received to the control panel are processed by a logic LS specific to the machine to be controlled and which "filters out", regroups and directs the given orders so as to retain only compatible orders capable of being transmitted simultaneously, depending on preestablished priority rules. Any possible command errors for example by pushing undesirably on two keys in the same time can thus be avoided.

The orders transmitted in binary form from the specific logic LS are thereafter applied to a binary encoder CB which provides for biphased encoding of the orders in successive bits within successive sequences. The sequential signal is then transmitted to a modulator M preferably adapted to act as a 60% amplitude modulator followed by a radiofrequency transmitter ERF equipped with an antenna A. The power required for the operation of the transmitter section is supplied from a storage battery BA adapted to supply the required energy at least for the duration of a working period (generally 8 hours).

The carrier wave radiated from the transmitter ERF is received by the antenna A' of a receiving element RRF of the receiving section R which provides a demodulated signal to a decoding authorization stage AD for checking for predetermined validity criteria. After authorization the demodulated signal is decoded in a binary decoder DB. The binary orders so obtained in parallel are processed by a specific logic LS' followed by an output stage S connected to the control members of the remotely controlled machine. This receiver section R comprises moreover a supply power stage AR; it is possibly connected to the supply powers on the machine.

The main elements of the transmitter and receiver assembly are specified hereinbelow within the scope of an application for remote control of an undercutter machine in a stope.

It is first specified that at frequencies of about 160 MHz, the electromagnetic field currently weakens in a subterranean working site by 20 dB over 10 m, whereas complementary losses which can be roughly estimated to 30 dB may occur due to unfavorable orientation of the antenna of the transmitter relative to that of the receiver, or due to a masking effect caused by any obstacles. In view of the sensitivity of the radio-frequency receiver (1 microvolt minimum for a single remote control channel), the antenna efficiency and the mentioned losses, it is reckoned that for providing a range of 15 meters between transmitter and receiver in a subterranean working site, a transmission level of 100 mW is required, which means significant power consumption.

Fundamentally, the logic LS specific to the transmitter and that of the receiver are non standard elements which are defined for each particular case as applied to the machine to be remotely controlled.

However, the specific logic LS of a remote control transmitter for an undercutter machine can be standardized in as much as the control of the presently known types of undercutters can be reduced to:

1 variable order: displaying the sense and the speed of motion by means of a switch or slider for example with 31 positions, and up to 15 non simultaneous discrete orders by means of push-buttons.

The remote control of an undercutter machine therefore requires only 9 information bits, i.e. four bits for the pulse like orders ($2^4=16>15$), and five bits for the variable order ($2^5=32>31$). The total of the 13 information bits is therefore not indispensable.

Figure 4:
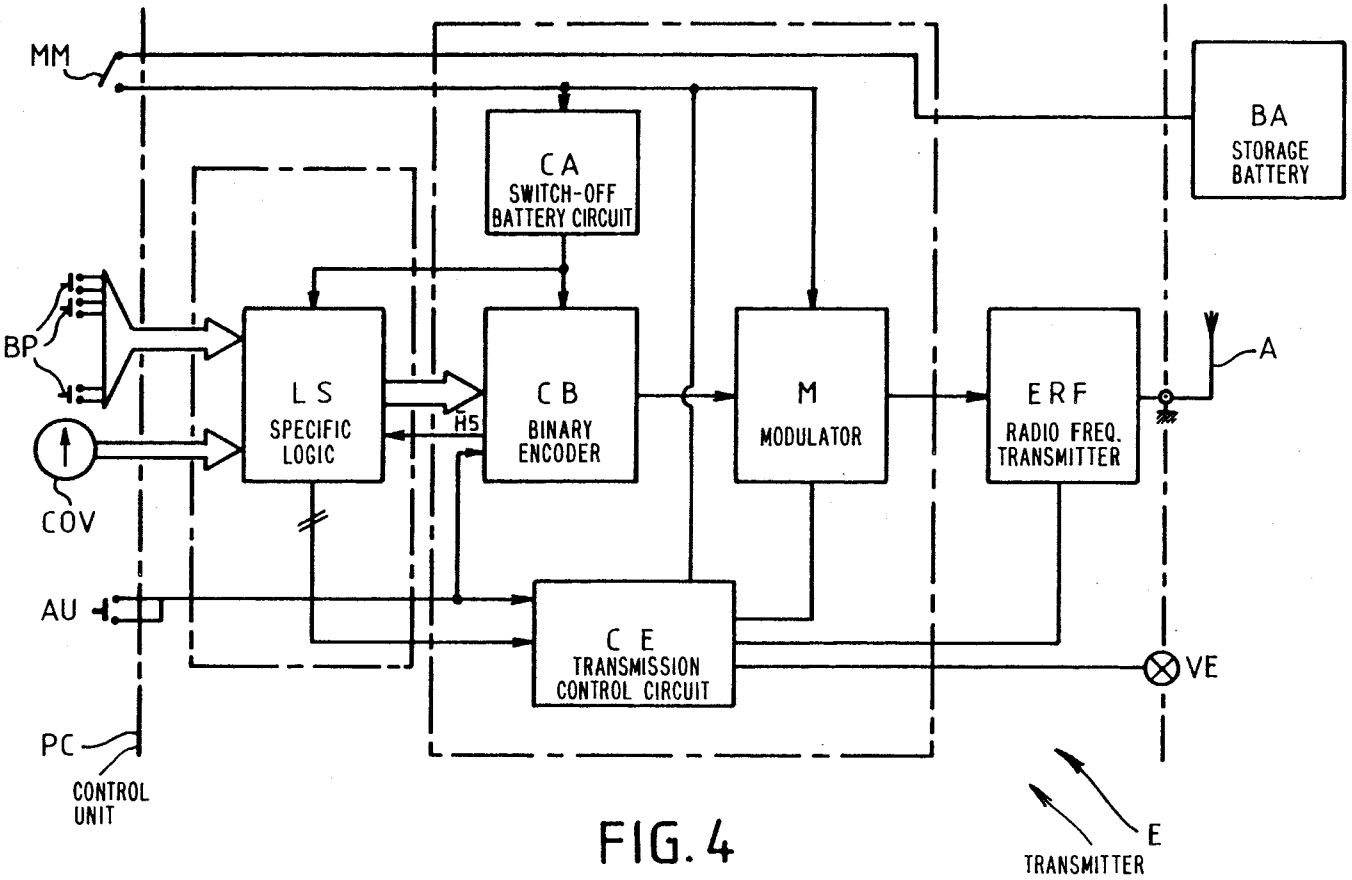
FIG. 4 is a block diagram of the transmitter section of the transmitter and receiver assembly of FIG. 3.

FIG. 4 schematizes the arrangement of the various constituents of a transmitter E assembly according to FIG. 3.

The control unit PC comprises push-buttons BP, a variable order switch COV, an emergency stop button AU and a switch-on button MM.

The switch-on button controls the supply of power to the transmitter E through its storage battery block BA. A switch-off battery circuit CA advantageously permits switching off the specific logic LS and the binary encoder CB when the power supply voltage from the storage battery block is lower than a threshold (for example 8.9 V for a reference voltage of 9.6 V). Then, there is no longer any order emission thereby avoiding any emission of incorrect order.

Figure 5:
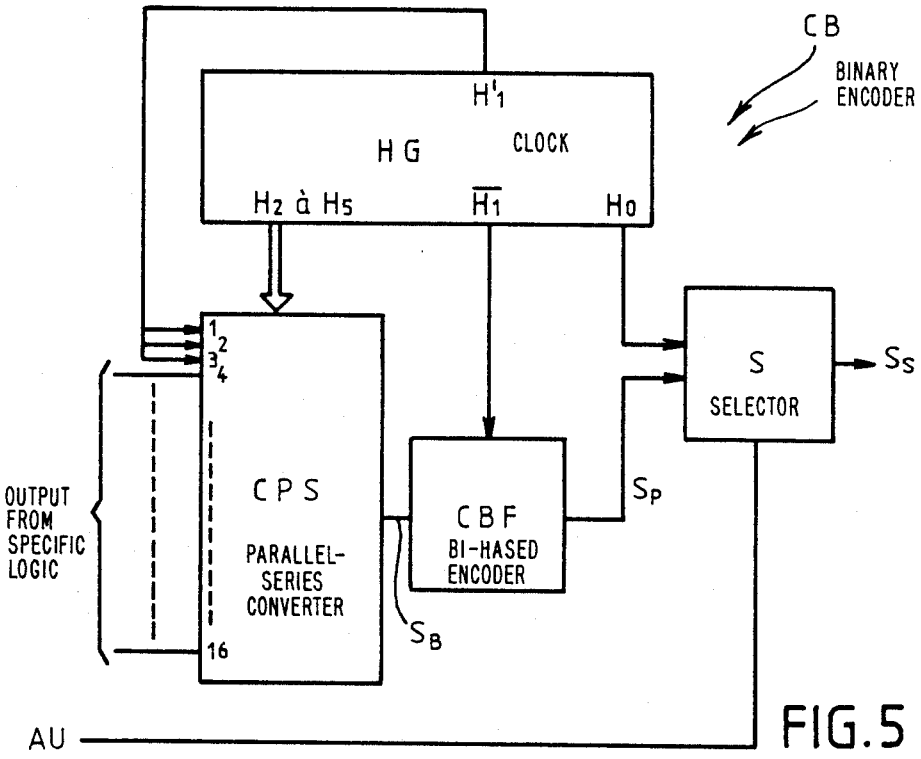
FIG. 5 is a block diagram of the binary encoder of the transmitter of FIG. 4.

FIG. 5 shows the arrangement of the main constituents of the binary encoder CB. This encoder comprises a clock HG and a parallel-series converter CPS, the three first inputs of which, 1 to 3, receive the clock signal $H'_1$; the 13 other inputs 4 to 16 are connected with the output from the specific logic. Converter CPS also receives in particular the signal $H_5$ which defines a conversion frequency according to which it is operated. It supplies at its output the signal $S_B$ defined in reference to FIG. 2 as a function of the binary states of its inputs 4 to 16 and which is applied to a biphased encoder CBF which after combination with the clock signal $\overline{H}_1$ supplies the primary binary signal $S_p$. A selector S supplies from its output a signal $S_s$ which takes again either $S_p$ or the signal $H_0$, depending on whether the signal AU applied thereto is zero or not zero.

Signal $S_s$ is applied to the modulator M which consequently acts upon the radiofrequency transmitter ERF.

The modulator M and the transmitter ERF are advantageously put under control of a transmission control circuit CE itself put under the control of the specific logic and the emergency stop push-button AU.

As a matter of fact, according to an advantageous characteristic of the invention, the transmission is intermittent, for example, for 20% of the time (200 ms per second). Thus, a supply power unit of a type (9.6 V-450 mAh of nominal capacity) which for a consumption of a transmitter of 70 mA could have an autonomy of roughly 6 hours provides an autonomy higher than a duration of a working period with an average consumption of power that can be evaluated to 25 mA.

Moreover, according to the invention, it is contemplated that this chopped transmission mode be replaced by a permanent mode of transmission as soon as a change detected by the specific logic occurs in the orders. Thus, the permanent transmission is restored for a predetermined time interval (for instance, 0.5 s) for any permanent order change (variable order such as the sense and speed of motion), or for the application time of the push-buttons for the temporary orders (for example, discrete pulse-like commands for a jack or contactors). Permanent transmission is of course restored in case of emergency stop. In this way, the quickness of response and the safety of operation are ensured.

It can be estimated that during a working period of 8 hours, the total duration of the successive orders as issued from the transmitter is in the order of 2 hours (maximum 3 hours). It is observed then that the discharge of a power supply block of the above mentioned type is 65% to 75% of its capacity, thereby leaving a good margin of safety and autonomy even when the power supply storage block is worn out.

The control of these two modes of transmission whether chopped or permanent is provided by the transmission control circuit CE depending on the signals of push-button AU and the specific logic LS adapted to detect any change in the orders whether discrete (temporary) or permanent (variable). Advantageously, a light VE is switched on in case of transmission.

It is to be noted that the chopped or intermittent transmission mode is compatible with the failure stopping condition generally imposed upon machine remote controls when the maximum time of absence beyond which the stopping order is emitted is significantly higher than the duration of the periodic intermittences, beyond preferably two seconds, in the considered example.

Preferably, during the intermittence periods in the intermittent transmission mode, the transmitter supplies an unmodulated signal (only the carrier frequency) at a level of about 1 mW instead of 100 mW of power (on 50 ohms) in transmission. This mode of transmission of the carrier frequency in a dimmed condition is interesting because very little current is consumed, this being the reason for the intermittent transmission while ensuring at the receiver quick restoration of synchronization.

The carrier frequency selected from the very high frequency range VHF is advantageously comprised between 154 and 174 MHz (preferably 156 and 165 MHz).

Figure 6:
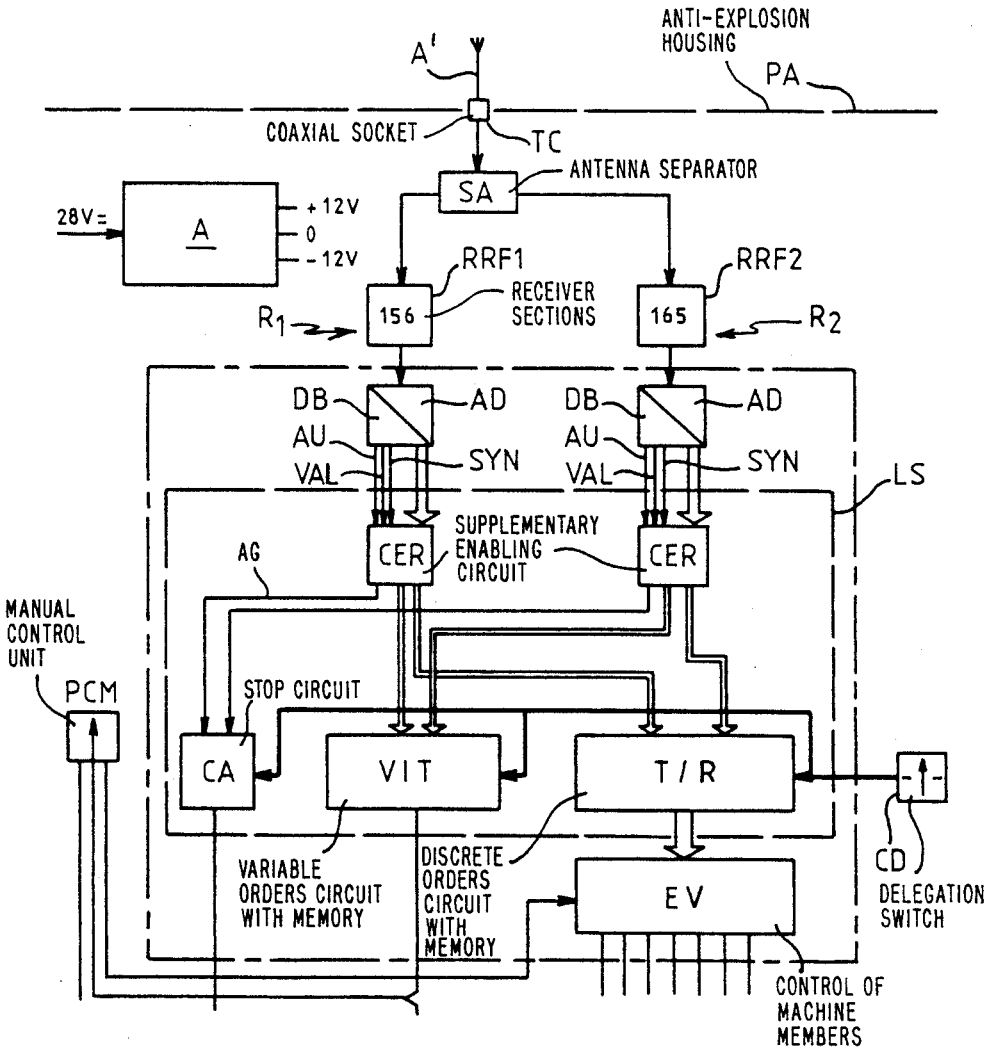
FIG. 6 is a block diagram of a receiver assembly associated with two transmitter assemblies according to FIG. 4 in association with an undercutting machine.

FIG. 6 is a schematic diagram of a receiver assembly adapted to ensure remote control of an undercutter machine from two transmitters of the type described in reference to FIG. 4. Such receiver assembly comprises two receiver sections $R_1$ and $R_2$ connected to one and the same antenna A'.

The receiving section is contained in an anti-explosion housing PA provided with a coaxial through socket TC adapted for not inducing mismatching on the connection to the antenna A'.

The signals received by antenna A' are first treated by an antenna separator SA adapted to separate the signals of both of the channels used (156 and 165 MHz in the example considered) such that at the input to each radiofrequency receiver RRF1 or RRF2 the signals from the other channel is applied at a limited level. The separator comprises a power divider and two channel filters.

The receivers RRF1 and RRF2 are receivers of the double frequency change superheterodyne type comprising a silence (squelch) circuit adapted to enable the output of the demodulated signals only when its level is higher than a threshold for example by 2 $V_{RMS}$, as well as a very efficient automatic gain control device for supplying a very high input dynamic thereto. Such receivers are set to require in the intermittent transmission mode only a transitory response duration of 30 ms owing to the permanence of the carrier wave, which is low relative to the 200 ms of each transmission cycle.

Figure 7:
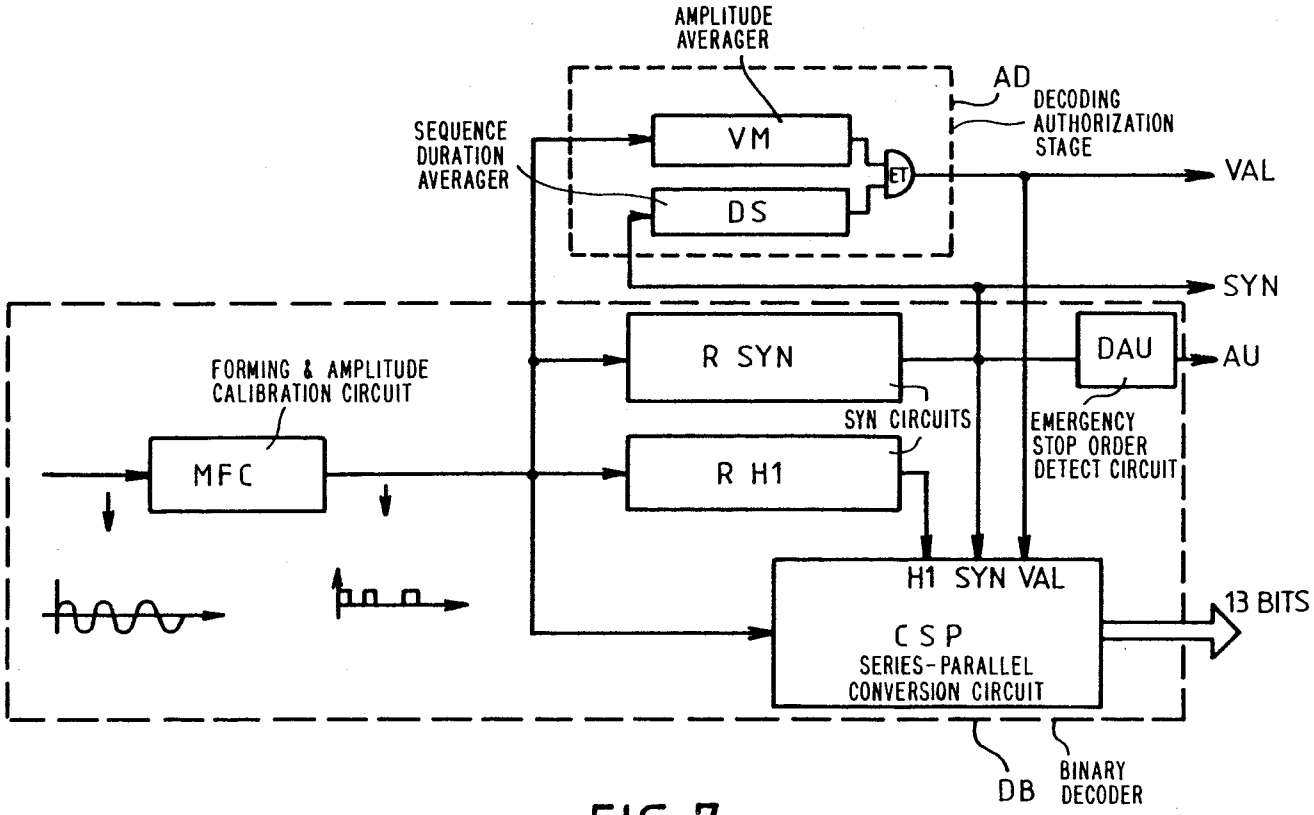
FIG. 7 is a block diagram of the enabling and decoding system of FIG. 6.

The receivers RRF1 and RRF2 supply, at their outputs, signals which a priori are equivalent to the modulation signals from the transmitters and which are taken care of by decoding stages, the schematic structure of which is specified in FIG. 7.

Such signal supplied after demodulation by the receiver RRF1 or RRF2 first flows through a forming and amplitude calibration circuit MFC which converts it to a binary signal. This is actually not strictly similar to the signal supplied by the binary encoder of the transmitter, in particular due to the propagation hazards encountered by the modulated electromagnetic wave (permanent variations of level of the received signal), random noise, electromagnetic disturbances and distortions introduced by the electronic circuits. With the binary decoder DB there are therefore advantageously associated identification circuits adapted to trace and eliminate such alterations or to interrupt the decoding.

It appears from FIG. 7 that the decoding authorization stage AD and binary decoding stage DB are actually in parallel.

The main point in the decoding is recovering the rhythms so as to be able to define accurately the beginning of each sequence and of each bit in each sequence so as to correctly control successive conversions of the calibrated signals such as supplied at the output from circuit MFC into parallel command orders that can be exploited for controlling the suitable members of the machine in question.

The calibrated binary signal is thus applied to synchronization circuits RSYN and RH1.

The circuit RSYN is intended for recovering the sequence renewal frequency from the calibrated sequential binary signal so as to produce a series-parallel conversion at the beginning of each sequence. Such circuit selects the components of the frequency $H_0$ of the transmitter (1700 Hz in the example considered) from the frequency spectrum of the calibrated binary signal so as to build up a binary signal SYN which is at the maximum level in the presence of components at $H_0$ or at the zero level in the absence thereof. The 6 synchronization signals with which normally any sequence starts correspond to a maximum value of the signal SYN which becomes again zero thereafter so that each positive transition (zero toward one) of such signal SYN therefore corresponds to the beginning of a sequence and serves as a signal for triggering conversion for a series-parallel conversion circuit CSP to which there is also applied the calibrated binary signals supplied by the circuit MFC.

In the presence of the emergency signal AU, which admits of a single spectral component equal to $H_0$, the signal SYN remains blocked to its maximum value so that no positive transition can then be transmitted to converter CSP. Such permanent maximum value of SYN is detected by an emergency stopping order detection circuit DAU and the signal AU supplied by the latter becomes different from zero.

The circuit RH1 provides for a synchronization locking with the bit repetition frequency H1 in each sequence. This synchronization locking is not immediate in as much as the sequential signal admits of various spectral components. Such locking can be effected by generating one pulse for any transition of the calibrated signal, cancelling the pulses resulting from the negative transitions associated with frequency $H_0$, excitation of a band-pass filter, the central frequency of which is $H_0$, generating one pulse for any zero crossing of the response signal from said filter, and counting such pulses to recover the frequency H1, with a phase defined by the synchronization with SYN. The so obtained binary signal is denoted H1.

The converter CSP for which signals H1 and SYN are used as clock signals is moreover controlled by an enabling signal VAL emitted from the decoding authorization circuit AD. In the example of FIG. 7, the circuit AD consists of two circuits VM and DS each adapted to test a likelyhood criterion of the sequential calibrated binary signal.

The circuit VM sets up the average value of the amplitude of the calibrated signal. In view of the biphased encoding prescribed in accordance with the invention, such average value must be half the maximum level of the binary signal.

The circuit DS measures the average duration of the sequences from the signal SYN set up by the circuit RSYN and compares it with the foreseeable value from the frequency H5 of the transmitter.

A gate AND is connected to the outputs from circuits VM and DS and supplies to the converter CSP a triggering signal VAL which remains at a level different from zero as long as the likelyhood tests set up by the above mentioned circuits are satisfied. In the opposite case, any conversion of the calibrated binary signal is inhibited.

A conversion takes place for each sequence. The 13 bits of each sequence are delivered from the 13 parallel outputs from converter CSP and remain stored thereat until arrival of the results from the following conversion.

According to an advantageous characteristic of the invention, the specific logic LS of the receiving section of FIG. 6 comprises a supplementary enabling circuit CER for each channel.

Figure 8:
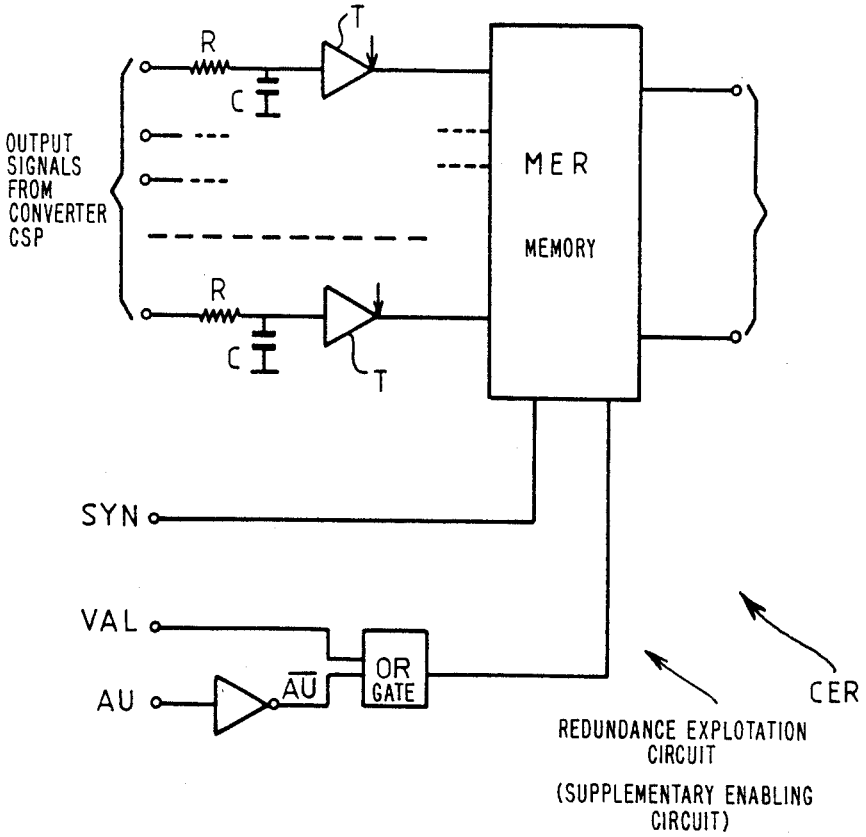
FIG. 8 is a block diagram of a redundance exploitation circuit connected at the output from the decoding system of FIG. 7.

The basic principle of these circuits CER is illustrated in FIG. 8. Such circuits are intended for exploiting the redundance normally present in the binary sequential signal owing to the fact that the command orders must remain in several consecutive sequences; in accordance with this invention, any change of state in one order bit of a sequence is only taken into account if such new state is maintained for a predetermined number for example 4, of consecutive sequences.

In accordance with FIG. 8, the output signals from converter CSP are applied to circuits RC which independently realize for each bit an average pseudo-value defined permanently over the last sequences. Threshold comparators T transform such analog signals to binary signals which are stored at each sequence in memory MER receiving the clock signals SYN. This memory supplies signals only in so far as the binary states successively received were identical for a sufficient number of sequences.

The circuit MER is put under control of a gate OR which causes its outputs to be unset when one of signals VAL or AU requires it.

It is to be noted that exploitation of the redundance leads to a very low order execution time which is entirely acceptable (of about 100 ms) even in the event of chopped or intermittent transmission wherein each transmission cycle which lasts 0.2 s comprises more than 10 sequences.

When the sequential signal is not enabled for a predetermined time (between preferably from 2 to 9 s) which is noted by a delay means, for example one associated with the circuit CER, a stopping of the machine by failure is advantageously produced in the same way as an emergency stopping order. A general stopping order AG is sent to a stop circuit CA.

The output signals from each circuit CER are distributed between a circuit VIT for taking into account the variable orders and a circuit T/R for taking into account discrete orders. Such circuits are put under control of a delegation switch CD through which the delegation rules between both of the transmitters are defined. Such switch admits preferably of 4 positions, i.e. remote control according to one or the other only of the channels (156 or 165 MHz) or remote control with two pilots with priority to one or the other of the channels. Practically, even in case of remote control with two pilots, one only of the channels is enabled to transmit orders of the variable type. These circuits VIT and T/R comprise memories for storing such delegation rules.

On the conditions that the delegation rules are satisfied the circuit VIT supplies an analog reference signal to a servo-mechanism controlling the working speed of the machine. Advantageously, the intermediary speeds corresponding to the variable orders transmitted by the transmitter and receiver assembly are regrouped, rather than being regularly distributed between the extreme speeds, within the range of the low speeds, to permit the pilot to exert great accuracy in controlling the machine at low speed. Such speeds are preferably the more spread out, the higher their level. The order and speed correspondence law desired by the user is set up by means of a programmable memory in the circuit VIT of the logic LS'.

The circuit T/R provides in combination with a stage EV for the control of the appropriate members in the machine such as electric valves.

Preferably, the machine comprises a manual control unit PCM.

It will be understood that the above description was only proposed by way of illustration and that many variations can be proposed by the man of the art without however departing from the spirit of the invention.

Moreover, it will be understood that the elements for realizing a transmitter and receiver assembly for carrying out the invention are within the man of the art's capability.

It is specified in particular that the number 13 for the information bits as mentioned in the description is not at all obligatory, since such number was only determined by the capacity of the series-parallel and parallel-series converters used.

The invention was described in reference to an undercutter machine adapted to simultaneously receive a maximum of two orders, one being variable (permanent), and the other discrete (temporary). It is obvious that this invention can also be applied to the control of a machine such as a conveyor carrier adapted to receive several simultaneous discrete orders. Then, it is sufficient to share the available information bits within the specific logic of the transmitter into as many groups as there are orders that might be emitted simultaneously. Thus, in case of a machine capable of receiving n simultaneous orders selected among N, the available information bits will be distributed into at least n groups corresponding to an equivalent number of independent order groups. It might be recalled that certain information bits may remain unused. Possibly, a bit corresponds to each order. Depending on the priority rules, imposed upon the specific logic of the transmitter, the maximum number of simultaneous orders is lower than or equal to the number of independent order groups.

The invention is obviously also applicable to a number of remote control channels higher than 2.

I claim:

1. A direct view remote control method for works machine, such as for mines and quarries, comprising the steps of:

converting orders selected by a driver of the machine in groups of independent orders into parallel binary signals, elaborating from said parallel binary signals a sequential binary signal consisting in successive sequences with a sequence frequency, each sequence consisting in a plurality of bits at a bit frequency distributed in synchronization bits occupied by a synchronization binary periodic signal at a synchronization frequency being a multiple of the bit frequency and in information bits including a biphased encoded binary signal representative of said binary signals, with a transition in each bit, the sense of which depends on the level of corresponding binary signal, directly modulating amplitude of a carrier wave with said sequential binary signal so as to define a remote control signal to be transmitted, transmitting said remote control signal, recovering a received modulation sequential binary signal after reception of said remote control signal, recovering sequence and bit frequencies in said received modulation sequential binary signal through recovery of said synchronization frequency, checking for predetermined validity criteria and supplying an authorization signal when said predetermined validity criteria are checked, converting said received modulation sequential binary signal, according to said recovered sequence and bit frequencies and said authorization signal, into appropriate electric signals for controlling said machine whereby rapid and reliable transmission of independent orders to said machine is allowed.

2. A remote control method according to claim 1, wherein the decoding of the binary sequential modulation signal is authorized only if the average duration of its sequences corresponds to that of the sequences before modulation of the carrier wave and if its average value is half its maximum level.

3. A remote control method according to claim 2, wherein a failure stop order is transmitted to the machine when no decoding authorization signal occurred for a predetermined time.

4. A remote control method according to claim 1, wherein after conversion of the restored modulation signal into parallel binary signals, the information contained therein is only taken into account when it corresponds to order changes if it is identically repeated for a predetermined number of successive sequences.

5. A remote control method according to claim 1 wherein the frequency of said synchronization binary periodic signal is an even multiple of transitory frequencies defined by transitions between logical levels in successive information bits, and including the step of transmitting an emergency stop signal wherein the emergency stop signal is a binary signal identical to synchronization signal however occupying information bits.

6. A remote control method according to claim 1 wherein said remote control signal obtained by modulation of the carrier wave is intermittently transmitted by cycles of several successive sequences;

and between the transmission cycles the unmodulated carrier wave is transmitted at a power lower by about 100 times than the normal transmission power.

7. A remote control method according to claim 6, wherein transmission of the remote control signal becomes again variable on changing order.

8. A remote control method according to claim 1, wherein the carrier wave has a very high frequency comprised between about 154 and 174 MHz.

9. A remote control method according to claim 1, wherein the sequences have a frequency of about 53.125 Hz and the synchronization signal has a frequency of about 1700 Hz.

10. A remote control method according to claim 1, wherein a plurality of at least two remote control signals are elaborated through modulation of a plurality of carrier waves respectively allocated to a plurality of drivers of the machine and, when said remote control signals are received, it is checked that respective orders transmitted therethrough are authorized according to predetermined rules of delegation between the drivers in said plurality of drivers.

11. A remote control method according to claim 1, wherein a failure stop order is transmitted to the machine when no decoding authorization signal occurred for a predetermined time.

12. A remote control method according to claim 6, wherein transmission of the remote control signal becomes again variable on changing order.

13. A direct view remote control apparatus for remote control of a machine in a bad working environment with the operator of the machine remaining in a protected position wherein said remote control apparatus includes a transmitter and receiver assembly comprising two transmitter sections and two receiver sections;

each said transmitter section including a control panel to be operated by and receive orders from the operator of the machine, a logic section specific to the machine being operated and connected to process orders received by said control panel, binary encoder means to receive orders in binary form from said logic section and perform biphased encoding of the orders in successive bits within successive sequences with a sequential signal output, with said sequential signal output further including a periodic synchronization signal in synchronization bits, a modulation means connected to said binary encoder means to receive said sequential signal output and produce a modulated carrier wave signal output, by direct modulation of carrier wave by said sequential signal output, a radiofrequency transmitter connected to said modulation means to receive said modulated carrier wave signal from said modulation means, transmitting antenna means connected to said radio frequency transmitter to transmit said modulated carrier wave signal, and power supply means to supply power to said transmitter section;

said two transmitter sections set to two neighboring frequencies of the carrier wave;

each said receiver section including receiving antenna means to receive said modulated carrier wave signal from said transmitting antenna means, an antenna selector adapted to distribute the remote control signals betwen said two receivers, each being associated with a carrier wave frequency and two binary decoders connected with a signal specific logic adapted to take into account the binary signals such as decoded according to rules of delegation between said transmitters as fixed by the position of a delegation switch, a receiving element connected to receive said modulated carier wave signal from said receiving antenna means and provide a demodulated signal therefrom, a decoding authorization means connected to receive said demodulated signal and check for predetermined validity criteria, synchronization means connected to receive said demodulated signal and recover frequency of said synchronization signal and supply a decoding clock signal, binary decoding means to decode said demodulated signal according to said decoding clock signal, upon authorization of said decoding authorization means obtaining binary orders in parallel therefrom, specific logic means to process said binary orders in parallel, an output stage connected to control members of the machine being remotely controlled, and power supply means to supply power to said receiver section.

* * * * *